US007364013B2

(12) United States Patent
Nitta et al.

(10) Patent No.: US 7,364,013 B2
(45) Date of Patent: Apr. 29, 2008

(54) SHELL MAIN BODY FOR MUFFLER

(75) Inventors: Seiichi Nitta, Tokyo (JP); Takao Shibata, Tokyo (JP); Koichi Takahashi, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 278 days.

(21) Appl. No.: 11/208,560

(22) Filed: Aug. 23, 2005

(65) Prior Publication Data

US 2006/0042872 A1 Mar. 2, 2006

(30) Foreign Application Priority Data

Aug. 25, 2004 (JP) ..... 2004-245772
Jun. 8, 2005 (JP) ..... 2005-168363

(51) Int. Cl.
*F01N 7/18* (2006.01)
*F01P 1/08* (2006.01)

(52) U.S. Cl. ..... 181/282; 181/227; 181/247; 181/249; 181/250; 181/255; 181/266; 181/269; 181/272; 181/273; 181/276

(58) Field of Classification Search ..... 181/227, 181/247, 249, 250, 255, 266, 269, 272, 273, 181/276, 282
See application file for complete search history.

(56) References Cited

U.S. PATENT DOCUMENTS 2,187,431 A 1/1940 Powell
2,958,389 A 11/1960 Deremer
3,531,345 A 9/1970 Torosian
3,557,904 A * 1/1971 Grote ..... 181/266
3,945,460 A * 3/1976 McMillan ..... 181/282
4,109,755 A * 8/1978 Grueneberg ..... 181/256
4,333,545 A 6/1982 Roberts
4,925,634 A 5/1990 Yokokoji et al.
5,365,025 A * 11/1994 Kraai et al. ..... 181/249
5,398,407 A 3/1995 Stuer
5,422,445 A 6/1995 Baird et al.
6,575,267 B1 * 6/2003 Stiles et al. ..... 181/282
2005/0252713 A1 * 11/2005 Takahashi ..... 181/227

FOREIGN PATENT DOCUMENTS

JP 09287430 A * 11/1997
JP 09287431 A * 11/1997
JP 2002-206422 A 7/2002

* cited by examiner

*Primary Examiner*—Lincoln Donovan
*Assistant Examiner*—Jeremy Luks
(74) *Attorney, Agent, or Firm*—Foley & Lardner LLP

(57) ABSTRACT

The shell main body for a muffler includes an inner shell in a cylindrical shape with a cross-section of an imperfect circle defined by small arc portions alternating with large arc portions; and an outer shell wrapping the inner shell and formed in a cylindrical shape similar to the inner shell. An end portion of the inner shell and an end portion of the outer shell are overlapped in a circumstantial direction of the shell main body to form a shell overlap portion that is capable of discharging vapor in a gap of the large arc portions formed between the inner shell and the outer shell into one of an outside and an inside of the shell main body. This shell overlapping portion is located in one of the small arc portions.

7 Claims, 5 Drawing Sheets

SHELL MAIN BODY FOR MUFFLER

BACKGROUND OF THE INVENTION

1. Field of the Invention

The present invention relates to a shell main body for a muffler that is used in an exhaust system of a combustion engine mounted on a motor vehicle or the like and is equipped with an inner shell and an outer shell wrapping an outer surface of the inner shell.

2. Description of the Related Art

As a shell main body for a muffler with an inner shell and an outer shell, a shell main body disclosed in Japanese Patent Application Laid-open No. 2002-206422 is conventionally known. As shown in a schematic cross-sectional view in FIG. 4, a shell main body 103 of this conventional muffler is formed of two layers of an inner shell 101 and an outer shell 102. Each of the inner and outer shells 101 and 102 has a cylindrical shape with a cross section that is not a perfect circle but is defined by small arc portions 104 and 104 alternating with large arc portions 105 and 105, similarly to an oval, a racing track-like figure, or the like.

The conventional shell main body 103 for the muffler described above, however, has the following problem. The shell main body 103 is provided at its edge portions with openings, which are closed by not-shown end plates by press caulking or welding, respectively. This structure makes it impossible for the end plates and the inner shell 101 to be welded to each other, thus causing not-shown minute gaps which are located between an inner surface of the end plates and the edge portions of the inner shell 101 and communicate an inner space of the shell main body 103 and gaps 104*a*, 104*b*, 105*a*, and 105*b* formed between the inner shell 101 and the outer shell 102, because the inner shell 101 are covered by the end plates and the outer shell 102.

Incidentally, the edge portions of the inner shell 101 and the outer shell 102 have overlap portions 108 that are welded with each other in a state that they are overlapped with each other at a top position and in a circumstantial direction of the shell main body 103.

Consequently, water enters the gaps 104*a*, 104*b*, 105*a*, and 105*b* formed between the inner shell 101 and the outer shell 102 due to capillary phenomenon through the gaps between the end plates and the inner shell 101 and accumulates on an inner portion of the muffler when water vapor in exhaust gas is cooled off into the water due to contact with a low-temperature shell wall of the muffler or drop in temperature after stopping an engine.

Then, the water that has entered the gaps 104*a*, 104*b*, 105*a*, and 105*b* is heated by high-temperature exhaust gas passing through the muffle to vaporize after restarting the engine, resulting in pressure rise of the vapor in the gaps 104*a*, 104*b*, 105*a*, and 105*b*. When this pressure rise speed exceeds a discharging speed of the vapor that is discharged from the gaps 104*a*, 104*b*, 105*a*, and 105*b* to the inner portion or an outside of the shell main body 103, vapor pressure in the gaps 104*a*, 104*b*, 105*a*, and 105*b* between the shells 101 and 102 sometimes rises to deform them.

Incidentally, water causing such a problem sometimes splashes onto an outer periphery of the shell main body 103 and enters into the gaps between the inner shell 101 and the outer shell 102.

Such a problem can be solved if a communicating path, for example a hole, is formed on a shell overlap portion at an upper surface side of the shell main body 103 so as to allow the gap between the inner shell 101 and the outer shell 102 to communicate with the outside of the outer shell 102 or gaps at the edge portion of the outer shell 102 is formed so that the vapor entered into the gap can pass through the gaps of the outer shell 102.

However, in a shell main body 103 having a cylindrical shape with a cross section that is not a perfect circle but is defined by small arc portions 104 and 104 alternating with large arc portions 105 and 105, similarly to an oval, a racing track, or the like, the inner shell 101 and the outer shell 102 in the right and left small arc portions 104 and 104 are in close contact with each other, clogging their right and left side gaps 104*a* and 104*b* and dividing the gap into an upper gap 105*b* and a lower gap 105*a* in the large arc portions 105 and 105 as shown in FIG. 5.

This clogging prevents the vapor generated in the lower gap 105*a* between the lower portions of the inner shell 101 and the outer shell 103 from discharging from the lower gap 105*a*, resulting in pressure-rise of the vapor to apply its pressure force P to and deform the lower portions of the shells 101 and 102 in an expansion direction. The lower large arc portion 105 of the shells 101 and 102 is deformable easily more than the small arc portions 104 and 104, because the former has stiffness smaller than the former.

It is undesirable to provide a lower side of the outer shell 102 with a not-shown communicating path or a not-shown shell overlap portion, similar to the shell overlap portion 108, that is fluidically connectable the lower gap 105*a* to the outside of the outer shell 102, because a splash and/or mud is easily allowed to enter the lower gap 105*a* through the communicating path or the shell overlap portion and rust the shell main body 103. Consequently, vapor entered the lower gap 105*a* can escape to nowhere, resulting in pressure rise in the lower gap 105*a* between the inner shell 101 and the outer shell 102. This may possibly deform the inner shell 101 and the outer shell 102.

SUMMARY OF THE INVENTION

It is an object of the present invention to provide a shell main body for a muffler that is capable of preventing deformation of a cylindrical shell main body due to vaporization of water entering a lower gap between an inner shell and an outer shell, in the cylindrical shell main body that constitutes a muffler and is formed by an inner shell and an outer shell each having a cylindrical cross section that is not a perfect circle but is defined by alternated small arc portions and large arc portions, similarly to an oval, a racing track, or the like.

In order to achieve the object stated above, a shell main body for a muffler according to one of the aspects of the present invention includes an inner shell formed in a cylindrical shape with a cross section that is noncircular and defined by left and right small are portions alternating with lower and upper large arc portions, an outer shell wrapping an outer surface of the inner shell and formed in a cylindrical shape with a cross section that is noncircular and defined by left and right small arc portions alternating with lower and upper large arc portions, and end plates secured to the outer shell to close openings of the shell main body. The left and right small arc portions of the outer shell contact with the left and right small arc portions of the inner shell, respectively. The inner shell and the outer shell are formed by double-rolling a flat plate so that the flat plate has an inner-side end portion and an outer-side end portion which are overlapped with a sandwiched portion of the flat plate located therebetween at one of the small arc portions in a circumstantial direction of the shell main body to form a shell overlap portion where the inner-side end portion and the outer end portion contact with the sandwiched portion of the flat plate. The other of the small arc portions of the inner shell and the other of the small arc portions of the outer shell contact with each other. The inner-side end portion, the outer-side end portion and the sandwiched portion of the shell overlap portion are spot-welded at positions at intervals in a longitudinal direction of the shell main body so that the inner-side end portion and the sandwiched portion form a first clearance therebetween for communicating a gap formed between one of the lower and upper large arc portions of the inner and outer shell and an inner space of the main shell body with each other through the first clearance and so that the outer-side end portion and the sandwiched portion form a second clearance therebetween for communicating a gap formed between the other of the lower and upper large arc portions and an outside of the main shell body with each other through the second clearance to discharge vapor in the gaps.

After water that pools in an inner space of the shell main body enters the gap formed between the inner shell and the outer shell and accumulates in the gap, the water is heated by high-temperature exhaust gas to vaporize after restarting an engine, resulting in pressure rise of the vapor in the gap. This pressure rise is suppressed by discharging the vapor in the gap through the clearance of the shell overlap portion into the inside or the outside of the shell main body, which prevents the shell main body from being deformed.

Preferably, the inner shell and the outer shell are formed of a double-rolled flat plate. This brings reduction of manufacturing cost with ensuring decrease of transmission noise and leak prevention of exhaust gas.

Preferably, the large arc portions are separated from each other in a vertical direction to be located in an upper position and a lower position of the shell main body, and the small arc portions are separated from each other in a horizontal direction to be located in side positions of the shell main body with connecting the large arc portions. Therefore, this structure enables the shell main body 3 to be short in height so as to avoid interference of the shell main body and a road surface with obtaining a necessary passage area for passing exhaust gas through an inside of it.

Preferably, the end portion of the outer shell is headed downward. Therefore, when rainwater and/or antifreezing agent that comes from the outside of the shell main body and adhere to an outer surface of the outer shell is transmitted through the outer surface and falls, but does not easily enter the gap through the clearance of the shell overlap portion.

Preferably, the end portion of the inner shell is headed upward and located at a position higher than a bottom portion of an inner surface of the inner shell. Therefore, water accumulated in the bottom portion of the shell main body does not easily enter the gap through the clearance of the shell overlap portion.

Preferably, the shell overlap portion is constructed by the end portion of the inner shell and the end portion of the outer shell that are spot-welded in positions at intervals in a longitudinal direction of the shell main body so that the clearance between the spot-welded positions allows the vapor to be discharged. This enables this gap for discharging the vapor to be easily formed at a low manufacturing cost, because its welding length is shorten to form the gap for vapor discharging.

Preferably, the shell overlap portion includes the end portion of the inner shell, the end portion of the outer shell, and a sandwiched portion that is sandwiched between the end portions with the sandwiching portion integrally connecting the inner shell and the outer shell and dividing the clearance into a first clearance for communicating the gap and the inside of the shell main body and a second clearance for communicating the gap and the outside of the shell main body. Therefore, this structure enables the overlap portion to be easily made of one flat plate and formed with the clearances for vapor discharging into the outside and the inside of the shell main body.

Preferably, at least one of the end portions is deflectable by pressure of the vapor in the gap so that a vapor-discharging area of the clearance is spread. Therefore, the clearance has a small area to prevent water from entering the gap therethrough when pressure is low in the gap, and it has a large area to discharge vapor in the gap therethrough into the inside or outside of the shell main body.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, embodiments of the present invention will be described with reference to the accompanying drawings.

First, a shell main body for a muffler of an embodiment will be described with reference to the accompanying drawings of FIGS. 1 and 3.

Figure 1:
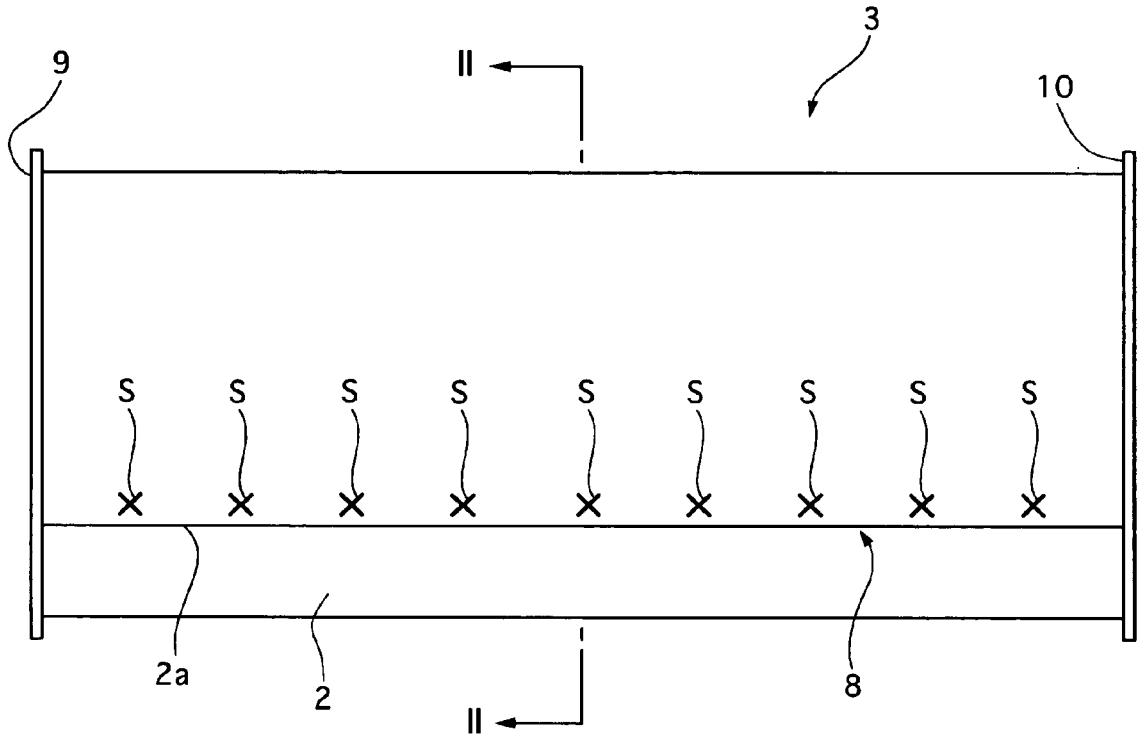
FIG. 1 is a plane view showing a shell main body for a muffler, which has an inner shell and an outer shell, of an embodiment according to the present invention.
Figure 2:
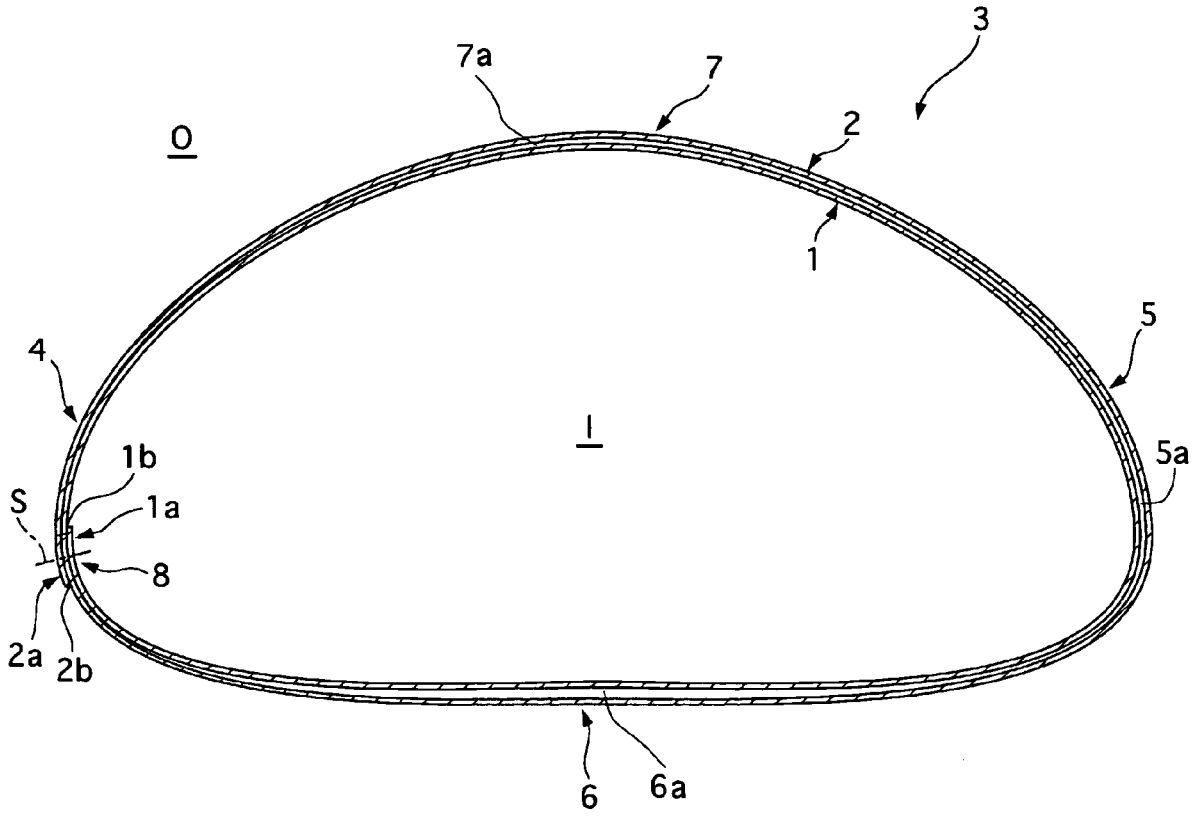
FIG. 2 is a cross-sectional view showing the shell main body taken along the II-II line in FIG. 1.
Figure 3:
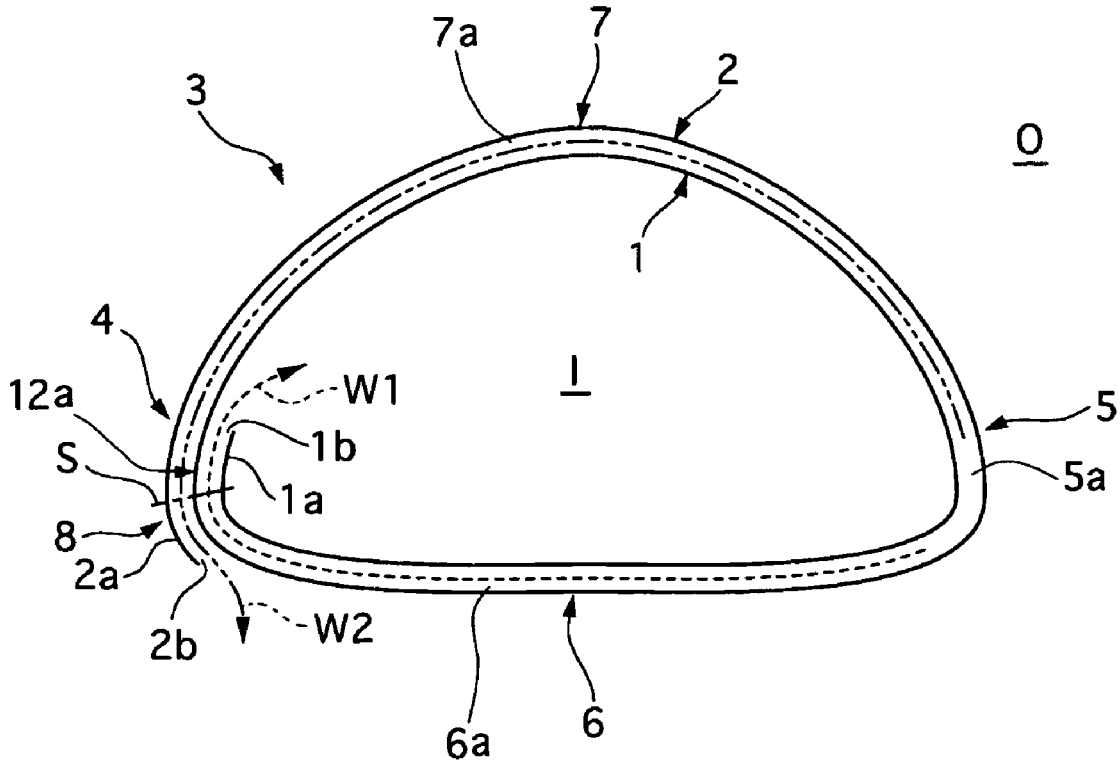
FIG. 3 is a schematic diagram illustrating how vapor discharges from gaps formed between the inner shell and the outer shell of the shell main body shown in FIGS. 1 and 2 to an outside and an inside thereof.
Figure 4:
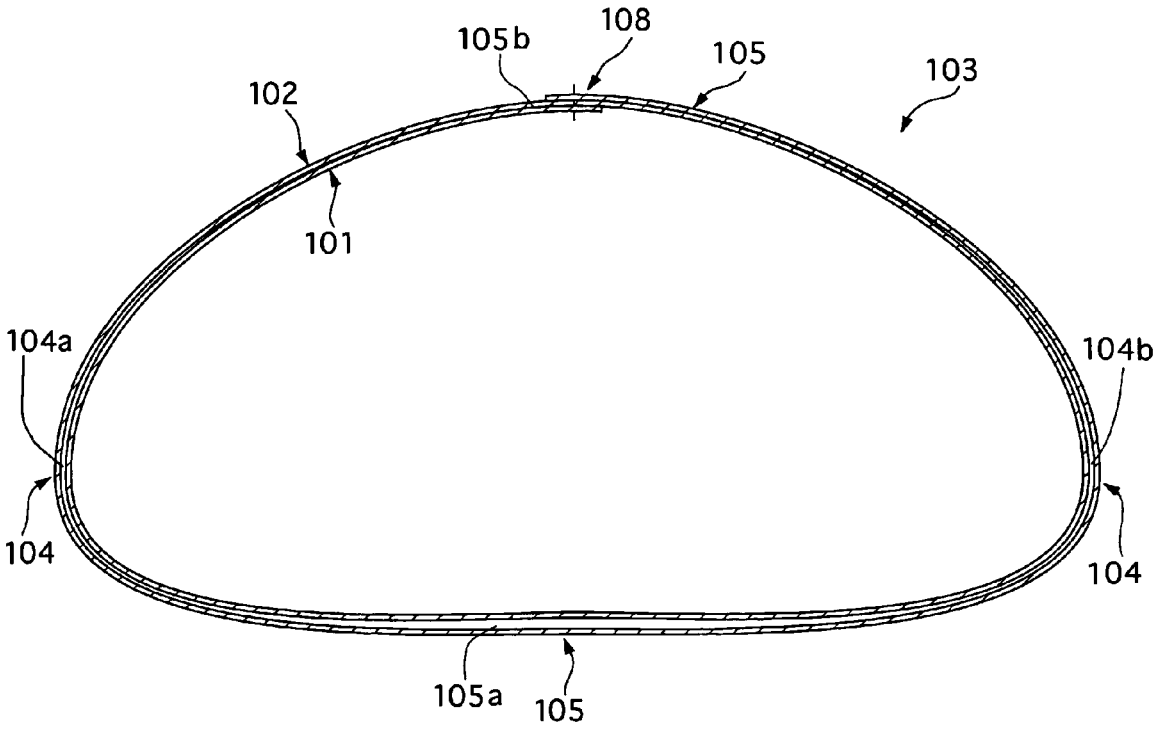
FIG. 4 PRIOR ART
FIG. 4 is a schematic cross-sectional view showing a conventional shell main body for a muffler.
Figure 5:
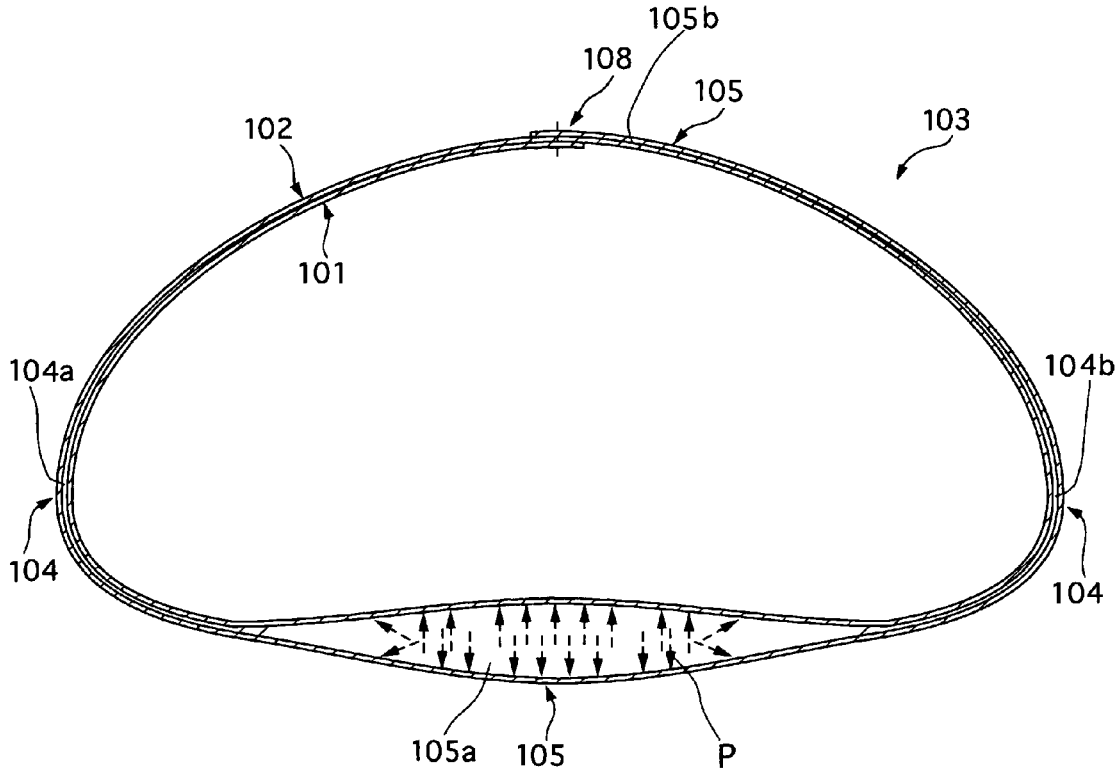
FIG. 5 PRIOR ART
FIG. 5 is a cross-sectional view showing the conventional shell main body shown in FIG. 4 that is in a state that lower portions of an inner shell and an outer shell of the shell main body deform in an expansion direction due to vapor rise in a gap formed between the lower portions.

FIG. 1 is a plane view showing the shell main body of the embodiment, FIG. 2 is a cross-sectional view showing the shell main body taken along the II-II line in FIG. 1, and FIG. 3 is a schematic diagram illustrating a state of vapor discharging in the shell main body shown in FIGS. 1 and 2.

The shell main body 3 of the embodiment is used for a muffler of an exhaust system mounted on a motor vehicle. The muffler is connected at its both ends with not-shown exhaust pipes. The shell main body 3 is made of a double-rolled flat plate, formed of two layers of an inner shell 1 and an outer shell 2 so that it has a laterally long, flattish cylindrical shape with a cross section substantially in a laterally long, rounded triangle shape.

The shell main body 3 has small arc portions 4 and 5 alternating with large arc portions 6 and 7, the small arc portions 4 and 5 having a small curvature in a state that the inner shell 1 and the outer shell 2 are attached almost firmly to each other to form a left clearance, which will be described later, and a right gap 5*a*, and the large arc portions 6 and 7 having a large curvature in a state that a lower gap 6*a* and an upper gap 7*a* are formed between the inner shell 1 and the outer shell 2.

The small arc portions 4 and 5 are separated from each other in a horizontal direction to be located in side positions of the shell main body 3 with connecting the large arc portions 6 and 7, and the large arc portions 6 and 7 are separated from each other in a vertical direction to be located in an upper position and a lower position of the shell main body 3. The small arc portions 4 and 5 and the large arc portions 6 and 7 form an inner space I inside of them so as to pass exhaust gas.

At the left small arc portion 4, inner-side portion 1*a* of the flat plate of the inner shell 1 and an outer-side portion 2*a* of the flat plate of the outer shell 4 are overlapped in a circumstantial direction of the shell main body 3 to each form a shell overlap portion 8 being spot-welded in positions S that are a predetermined interval apart from one another in a longitudinal direction of the shell main body 3. The shell overlap portion 8 further includes a sandwiched portion 12*a* of the plate that is sandwiched between the inner-side portion 1*a* of the flat plate and outer-side portion 2*a* of the flat plate, thus having three-layer shell portions.

In this embodiment, an overlap amount of the shell overlap portion 8 (an overlap amount of inner-side portion 1 *a* of the flat elate of the inner shell 1 and the outer-side portion 2*a* of the flat plate of the outer shell 2) is 20 mm, and a center portion of the shell overlap portion 8 is spot-welded in the positions S such that three-layer shell portions are fixed to one another at the shell overlap portion 8. Non-welded portions between the spot-welded positions S form the clearance for discharging water vapor in the gaps 5*a*, 6*a*, and 7*a*.

The inner-side portion 1*a* of the flat plate of the inner shell 1 is positioned in the small arc portion 4 to be erected upward from a bottom portion of an inner space I of the shell main body 3 to be located at a position higher than the bottom portion and secured to an inner peripheral surface of the sandwiched portion 12*a* at spot-welded positions S, while an outer-side portion 2*a* of the flat plate of the outer shell 2 is headed downward in the small arc portion 4 and secured to an outer peripheral surface of the sandwiched portion 12*a* at the spot-welded positions S.

The shell overlap portion 8 is formed to have the clearance, which includes a first clearance 1*b* formed between the inner-side portion 1*a* of the flat plate of the inner shell 1 and an inner peripheral surface of the sandwiched portion 12*a* and a second clearance 2*b* formed between the outer-side portion 2*a* of the flat plate of the outer shell 2 and an outer peripheral surface of the sandwiched portion 12*a*. The end portions 1*b* and 2*b* are deformable to spread their discharging areas and discharge the vapor in the gaps 5*a*, 6*a*, and 7*a* when pressure of vapor in the gaps 6*a* and 7*a* becomes high.

In the inner space I of the shell main body 3, not-shown interior parts, such as baffle plates, communicating pipes, and others, are contained. Openings of both edge portions of the shell main body 3 are closed by end plates 9 and 10, respectively, by press-caulking or welding the end plates 9 and 10 and the edge portions of the outer shell 2. The end plate 9 is fixed to a not-shown inlet exhaust pipe, and the end plate 10 is fixed to a not-shown outlet exhaust pipe, so that the inner space I is communicated with the inlet exhaust pipe and the outlet exhaust pipe to flow exhaust gas outputted from an engine to the outside with decreasing transmission noise of the gas.

Next, the operation of the shell main body 3 of the first embodiment will be described.

In the muffler, the shell main body 3 is made of a double-rolled flat plate so that it is formed of two layers of the inner shell 1 and the outer shell 2, which brings decrease of transmission noise and leak prevention of exhaust gas.

On the other hand, water, such as flocculated water generated from water vapor contained in exhaust gas by cooling-off, pools in the inner space I of the shell main body 3 and sometimes enters the gaps 1*b*, 2*b*, 5*a*, 6*a*, and 7*a* formed between the inner shell 1 and the outer shell 2 through gaps between the end plates 9 and 10 and the edge portions of the inner shell 1 and/or the gap 2*b* at an end portion 2*a* of the shell overlap portion 8, then accumulating in the entire gaps 5*a*, 6*a*, and 7*a* formed between the inner shell 1 and the outer shell 2 and the clearances 1*b* and 2*b*.

Note that although the inner shell 1 and the outer shell 2 are closely contacted with each other in their small arc portions 4 and 5, the water is pooled in the whole clearances 1*b* and 2*b* and the gap 5*a* of the small arc portions 4 and 5 due to capillary phenomenon.

The muffler is thereafter heated by the exhaust gas discharged from the engine in operation after restarting the engine, so that the water vaporizes to increase its volume, resulting in increase of pressure in the gaps 5*a*, 6*a*, and 7*a* formed between the inner shell 1 and the outer shell 2.

In this embodiment, the shell main body 3 is constructed such that the small arc portions 4 and 5 of the inner shell 1 and the outer shell 2 are in contact with each other with the small arc portion 4 being provided with the shell overlap portion 8, which enables the water vapor in the gaps 6*a* and 7*a* of the large arc portions 6 and 7 to apply its expansion force and deform the inner-side portion 1*a* of the flat plate and outer-side portion 2*a* of the flat plate for spreading discharging areas of the first and second clearances 1*b* and 2*b* of the shell overlap portion 8. The inner-side portion 1*a* of the flat plate and outer-side portion 2*a* of the flat plate are weaker in stiffness than the other portions of the shell main body 3 to be easily deformed by the expansion force of the vapor in the large arc portions 6*a* and 7*a*, and the left arc portion 4 so that the clearances 1*b* and 2*b* of the inner-side portion 1*a* of the flat plate and outer-side portion 2*a* of the flat plate located between the welded positions S are enlarged to pass the vapor in the large arc portions 6*a* and 7*a* through the clearances 1*b* and 2*b*, because the inner-side portion 1*a* of the flat plate and outer-side portion 2*a* of the flat plate are easily deformable due to their low stiffness.

In detail, as schematically shown in FIG. 3, the vapor accumulated in the lower gap 6*a* of the lower large arc portion 6 is discharged, as indicated by an arrow W1 in FIG. 3, to the inner space I of the shell main body 3 through the first clearance 1*b* of the shell overlap portion 8 formed between the inner-side portion 1*a* of the flat plate of the inner shell 1 and the sandwiched portion 12*a*, with spreading the clearance 1*b* by the vapor pressure. Accordingly, the clearance 1*b* enables pressure rise due to the water accumulated in the lower gap 6*a* of the lower large arc portion 6 to be suppressed, and thereby preventing the lower large arc portion 6 from being deformed.

The vapor accumulated in the upper gap 7*a* of the upper large arc portion 7 is discharged, as indicated by an arrow W2 in FIG. 3, to the outside O of the shell main body 3 through the second clearance 2*b* of the shell overlap portion 8 formed between the outer-side portion 2*a* of the flat plate of the outer shell 2 and the sandwiched portion 12*a*, with spreading the clearance 2*b* by the vapor pressure. Accordingly, the clearance 2*b* enables pressure rise due to the water accumulated in the upper gap 7*a* of the upper large arc portion 7 to be suppressed, and thereby preventing the upper large arc portion 7 from being deformed.

Incidentally, rainwater and/or antifreezing agent that comes from the outside and adhere to an outer surface of the outer shell 2 is transmitted through the outer surface and falls, but does not easily enter the second clearance 2*b* formed between the outer-side portion 2*a* of the flat plate and the sandwiched portion 12*a*, since the outer shell 2 is rolled around an outer surface of the inner shell 1 so that its outer-side portion 2*a* of the flat plate is headed downward.

On the other hand, water accumulated in the bottom portion of the shell main body 3 does not easily enter the first clearance 1*b*, since the inner-side portion 1*a* of the flat plate of the inner shell 1 is located at a position higher than the bottom portion of the shell main body 3. This also prevents the shell main body 3 from deformation due to vapor pressure rise in the gaps 5*a*, 6*a*, and 7*a*.

The shell main body 3 of the embodiment has the following advantages.

The shell main body 3 is made of one double-rolling flat plate and formed to have the inner shell 1 and outer shell wrapping the inner shell 1 each having noncircular cylindrical shape and defined by the small arc portions 4 and 5 alternating with the large arc portions 6 and 7, and one of the small arc portions 4 and 5 is provided with the shell overlap portion 8 with the clearance for discharging vapor in the gaps 5*a*, 6*a*, and 7*a* into the inside or outside of the shell main body 3. This brings decrease of vapor-pressure rise and prevents the inner shell 1 and the outer shell 2 from being deform by the vapor pressure rise.

The water accumulated in the bottom portion of the shell main body 3 does not easily enter the gap 7*a* through the first clearance 1*b* of the shell overlap portion 8, since the end portion 1*a* of the inner shell 1 is headed upward and located at the position higher than a bottom portion of the inner surface of the inner shell 1.

When rainwater and/or antifreezing agent that comes from the outside of the shell main body 3 and adhere to the outer surface of the outer shell 2 is transmitted through the outer surface and falls, but does not easily enter the gap through the second clearance 2*b* of the shell overlap portion 8, since the outer-side portion 2*a* of the flat plate of the outer shell 2 is headed downward.

In addition, manufacturing cost can be decreased, since the welded positions S for forming the shell overlap portion 8 are decreased.

While the invention has been particularly shown and described with reference to preferred embodiments thereof, it will be understood by those skilled in the art that the foregoing and other changes in form and details can be made therein without departing from the spirit and scope of the invention.

For example, although the embodiments have described the examples where the shell main body 1 has a cross section in a substantially rounded triangle shape, the shell main body 1 may have a cross section in any other shape, as long as it is not a perfect circle but is defined by alternated small arc portions and large arc portions, for example, a cross section in a laterally long, flattish shape such as an oval and a racing track, or a cross section in a substantially rectangular shape with small arc-shaped corner portions.

In the above embodiment, the inner shell 1 and the outer shell 2 are made of one flat plate, but they may be formed of two flat plates or more.

The entire contents of Japanese Patent Applications No. (Tokugan) 2004-245772 filed Aug. 25, 2004 and No. (Tokugan) 2005-168363 filed Jun. 8, 2005 are incorporated herein by reference.

What is claimed is:

1. A shell main body for a muffler, the shell main body comprising:

an inner shell formed in a cylindrical shape with a cross section that is noncircular and defined by left and right small arc portions alternating with lower and upper large arc portions;

an outer shell wrapping an outer surface of the inner shell and formed in a cylindrical shape with a cross section that is noncircular and defined by left and right small arc portions alternating with lower and upper large arc portions, the left and right small arc portions of the outer shell being contacted with the left and right small arc portions of the inner shell, respectively; and end plates secured to the outer shell to close openings of the shell main body; wherein the inner shell and the outer shell are formed by double-rolling a flat plate so the flat plate has an inner-side end portion and an outer-side end portion which are overlapped with a sandwiched portion of the flat plate located therebetween at one of the small arc portions in a circumstantial direction of the shell main body to form a shell overlap portion where the inner-side end portion and the outer end portion contact with the sandwiched portion of the flat plate, wherein the other of the small arc portions of the inner shell and the other of the small arc portions of the outer shell contact with each other, and wherein the inner-side end portion, the outer-side end portion and the sandwiched portion of the shell overlap portion are spot-welded at positions at intervals in a longitudinal direction of the shell main body so that the inner-side end portion and the sandwiched portion form a first clearance therebetween for communicating a gap formed between one of the lower and upper large arc portions of the inner and outer shell and an inner space of the main shell body with each other through the first clearance and so that the outer-side end portion and the sandwiched portion form a second clearance therebetween for communicating a gap formed between the other of the lower and upper large arc portions and an outside of the main shell body with each other through the second clearance to discharge vapor in the gaps.

2. The shell main body according to claim 1, wherein the outer-side end portion is headed downward.

3. The shell main body according to claim 1, wherein the inner-side end portion is headed upward and located at a position higher than a bottom portion of an inner surface of the inner shell.

4. The shell main body according to claim 2, wherein at least one of the inner-side and outer-side end portions is deflectable by pressure of the vapor in the gap so that a vapor-discharging area of the clearance is spread.

5. The shell main body according to claim 1, wherein the inner-side end portion is headed upward and located at a position higher than a bottom portion of an inner surface of the inner shell.

6. The shell main body according to claim 3, wherein at least one of the inner-side and outer-side end portions is deflectable by pressure of the vapor in the gap so that a vapor-discharging area of the clearance is spread.

7. The shell main body according to claim 1, wherein at least one of the inner-side and outer-side end portions is deflectable by pressure of the vapor in the gap so that a vapor-discharging area of the clearance is spread.

* * * * *